US010243292B2

(12) United States Patent
McGowan et al.

(10) Patent No.: US 10,243,292 B2
(45) **Date of Patent: *Mar. 26, 2019**

(54) HOLDER ASSEMBLY

(71) Applicant: Molex, LLC, Lisle, IL (US)

(72) Inventors: Daniel B. McGowan, Glen Ellyn, IL (US); David Rios, Naperville, IL (US)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/988,673

(22) Filed: May 24, 2018

(65) Prior Publication Data

US 2018/0269614 A1 Sep. 20, 2018

Related U.S. Application Data

(63) Continuation of application No. 14/911,034, filed as application No. PCT/US2014/050484 on Aug. 11, 2014, now Pat. No. 9,985,375.

(60) Provisional application No. 61/864,240, filed on Aug. 9, 2013.

(51) Int. Cl.

| | |
|---|---|
| ***H01R 13/40*** | (2006.01) |
| ***H01R 13/405*** | (2006.01) |
| ***F21V 19/00*** | (2006.01) |
| ***F21V 23/06*** | (2006.01) |
| ***H01R 33/05*** | (2006.01) |
| *H01R 13/24* | (2006.01) |
| *H01R 33/09* | (2006.01) |
| *F21Y 115/10* | (2016.01) |

(52) U.S. Cl.

CPC ..... *H01R 13/405* (2013.01); *F21V 19/003* (2013.01); *F21V 23/06* (2013.01); *H01R 33/05* (2013.01); *F21Y 2115/10* (2016.08); *H01R 13/2442* (2013.01); *H01R 33/09* (2013.01)

(58) Field of Classification Search

CPC ..... H01R 13/405

See application file for complete search history.

(56) References Cited

U.S. PATENT DOCUMENTS

| | | | |
|---|---|---|---|
| 7,510,400 | B2 | 3/2009 | Glovatsky et al. |
| 7,553,052 | B2 | 6/2009 | Suzuki |
| 8,591,053 | B2 | 11/2013 | Thullier et al. |
| 8,926,135 | B2 | 1/2015 | Zaderej et al. |
| 8,974,080 | B2 | 3/2015 | Zaderej et al. |
| 9,022,615 | B2 | 5/2015 | Miyashita et al. |

(Continued)

FOREIGN PATENT DOCUMENTS

| | | | |
|---|---|---|---|
| JP | 2013-093192 | A | 5/2013 |
| KR | 2013-0074990 | A | 7/2013 |
| WO | WO 2013-008363 | A1 | 1/2013 |

*Primary Examiner* — James Harvey
(74) *Attorney, Agent, or Firm* — Molex, LLC

(57) ABSTRACT

An embodiment includes a holder assembly with terminals that are supported by insert molding. The terminals are electrically connector to conductors, which can be covered with an insulative covering, and thus provide easy to connector holder assemblies. The holder can include features that allow an LED module to be inserted into a recess in the housing and retained via a friction fit. Such a configuration allows the assembly to be shipped as an assembly without the need to solder the LED module to the holder and while still ensuring a reliable electrical connection between the LED module and the corresponding holder assembly.

5 Claims, 16 Drawing Sheets

(56) References Cited

U.S. PATENT DOCUMENTS

| | | | | |
|---|---|---|---|---|
| 9,985,375 | B2 * | 5/2018 | McGowan ..... | H01R 13/405 |
| 2008/0144320 | A1 | 6/2008 | Tokunaga | |
| 2009/0207617 | A1 | 8/2009 | Merchant et al. | |
| 2011/0140136 | A1 | 6/2011 | Daily et al. | |
| 2012/0099328 | A1 | 4/2012 | Miyashita et al. | |
| 2013/0044485 | A1 | 2/2013 | Zaderej et al. | |
| 2013/0176732 | A1 | 7/2013 | McGowan et al. | |
| 2016/0178167 | A1 | 6/2016 | McGowan et al. | |
| 2016/0281966 | A1 | 9/2016 | Meyer | |

* cited by examiner

HOLDER ASSEMBLY

RELATED APPLICATIONS

This application is a continuation of U.S. application Ser. No. 14/911,034, filed Feb. 9, 2016, now U.S. Pat. No. 9,985,375, which is a National Phase application of PCT/US2014/050484 filed on Aug. 11, 2014 which claims priority to U.S. Provisional Application No. 61/864,240, filed Aug. 9, 2013, all of which are incorporated herein by reference in their entirety.

FIELD OF THE INVENTION

The present invention relates to field of solid state lighting, more specifically to the field of holders suitable for securing light emitting diode (LED) modules.

DESCRIPTION OF RELATED ART

LED modules are known as being well suited to providing illumination. While there are a number of different type of LED modules currently being offered, chip-on-board (COB) LED modules are useful for a number of applications. One issue with such LED modules is that the reduction in the size of the LED module has made it more difficult to use the LED module because it must still be connected to a power source and needs to be thermally connected to a support surface that can help dissipate thermal energy. Holders are known devices suitable for securing an LED module to a support surface (such as a fixture or heat sink).

Prior holders have either been loosely positioned in a holder or alternatively fixed to the holder with a solder or conductive adhesive between the terminals and the contact pads on the LED module—for example US Patent Publication No. 2013/0176732, filed Jul. 11, 2013 discloses a holder that can be soldered directly to a LED module. Such constructions are suitable for certain applications as they provide desirable performance but they also require additional processing steps and thus can increase the cost of the resultant system. Thus, further improvements to hold assemblies would be appreciated by certain individuals.

BRIEF SUMMARY

A holder assembly includes a housing with an aperture that is aligned with a recess on a bottom side of the housing, the recess being configured to accept an LED module. Terminals are positioned in a housing so that contacts extend into the recess. The terminals can be crimped to conductors that extend from the housing. The housing can be formed via an insert-molding operation that encloses both a portion of the terminals and the conductors. In an embodiment, the holder assembly can include an LED module positioned in the recess and a base of the LED module can have an interference fit with the housing. In an embodiment the housing can include a side opening with a plug inserted into the side opening and the plug can support the terminals.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
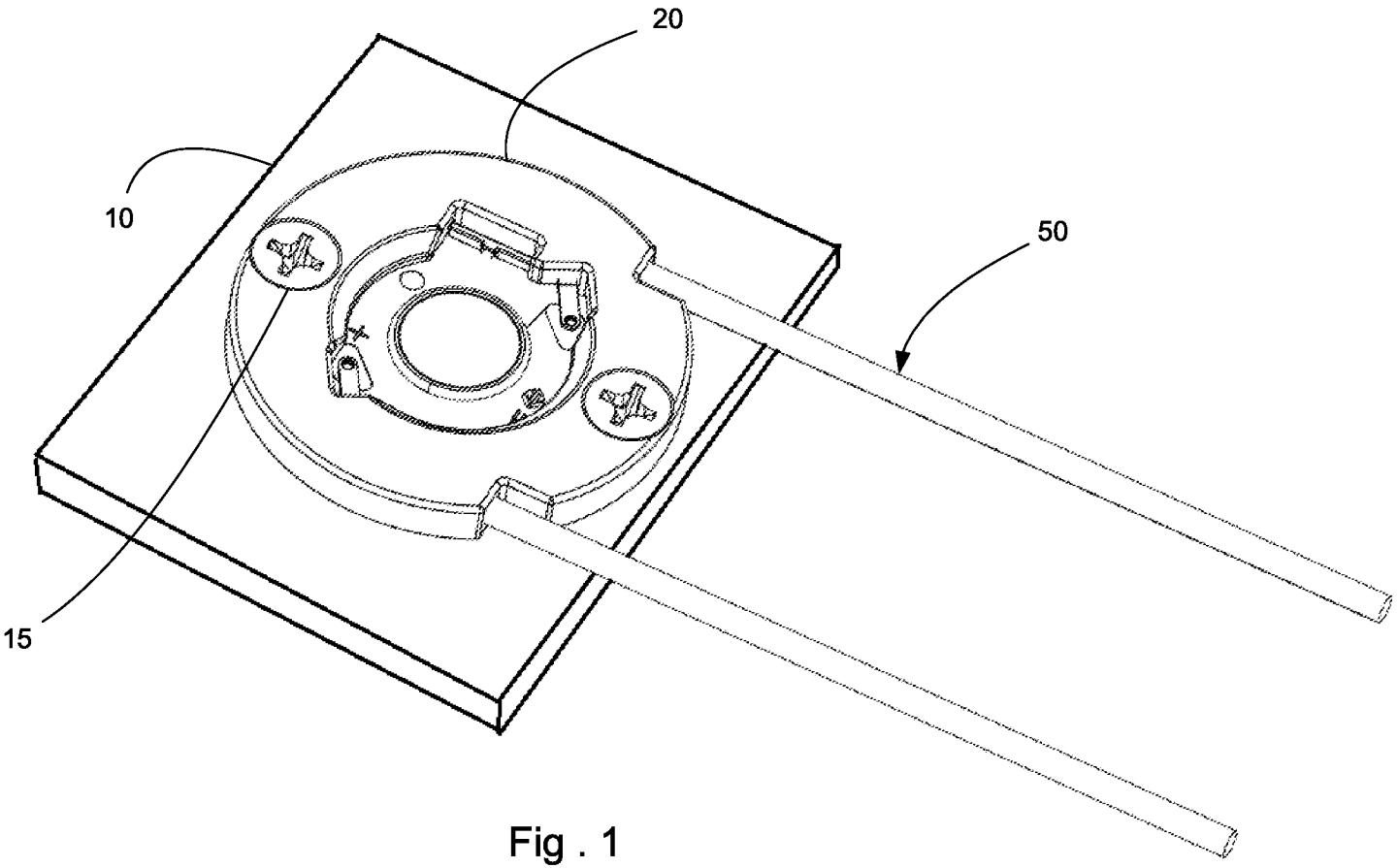
FIG. 1 illustrates a perspective view of an embodiment of an illumination system.
Figure 2A:
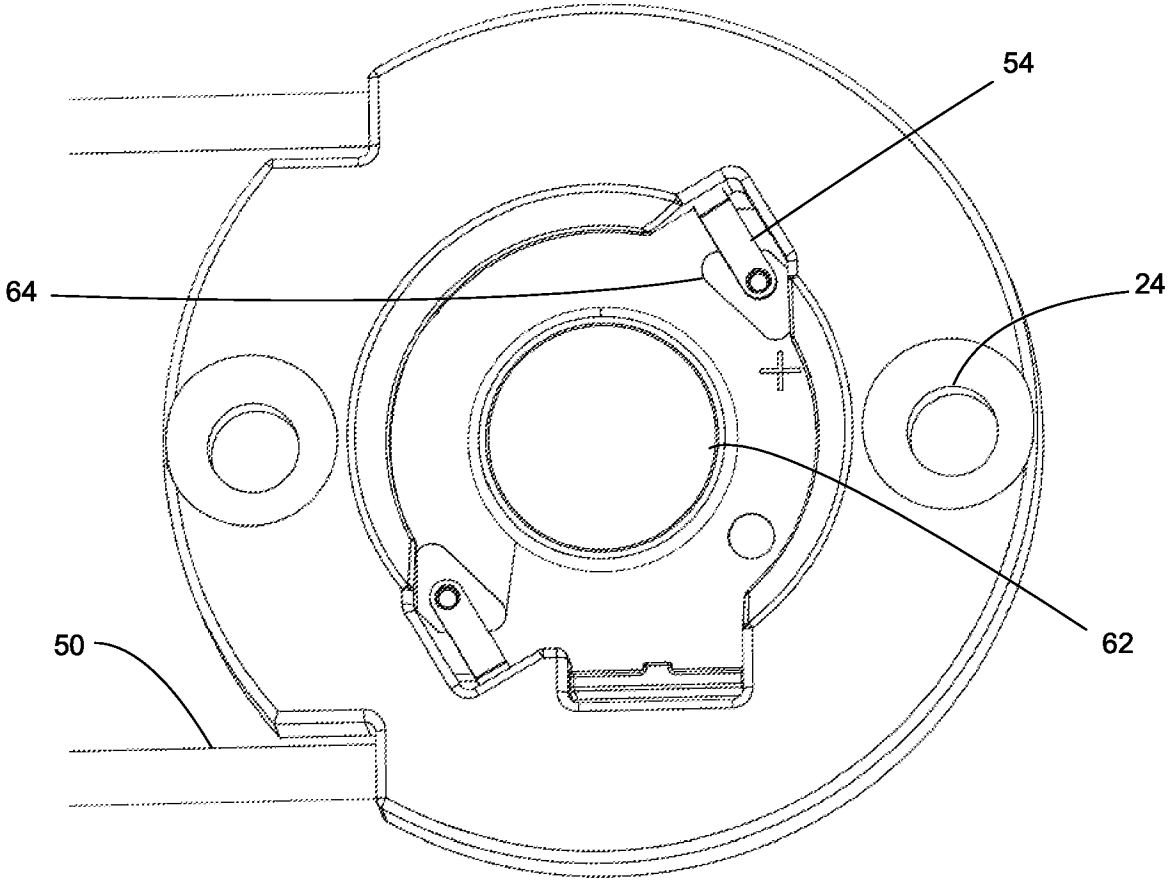
FIG. 2A illustrates a plan view of an embodiment of an LED holder assembly.
Figure 2B:
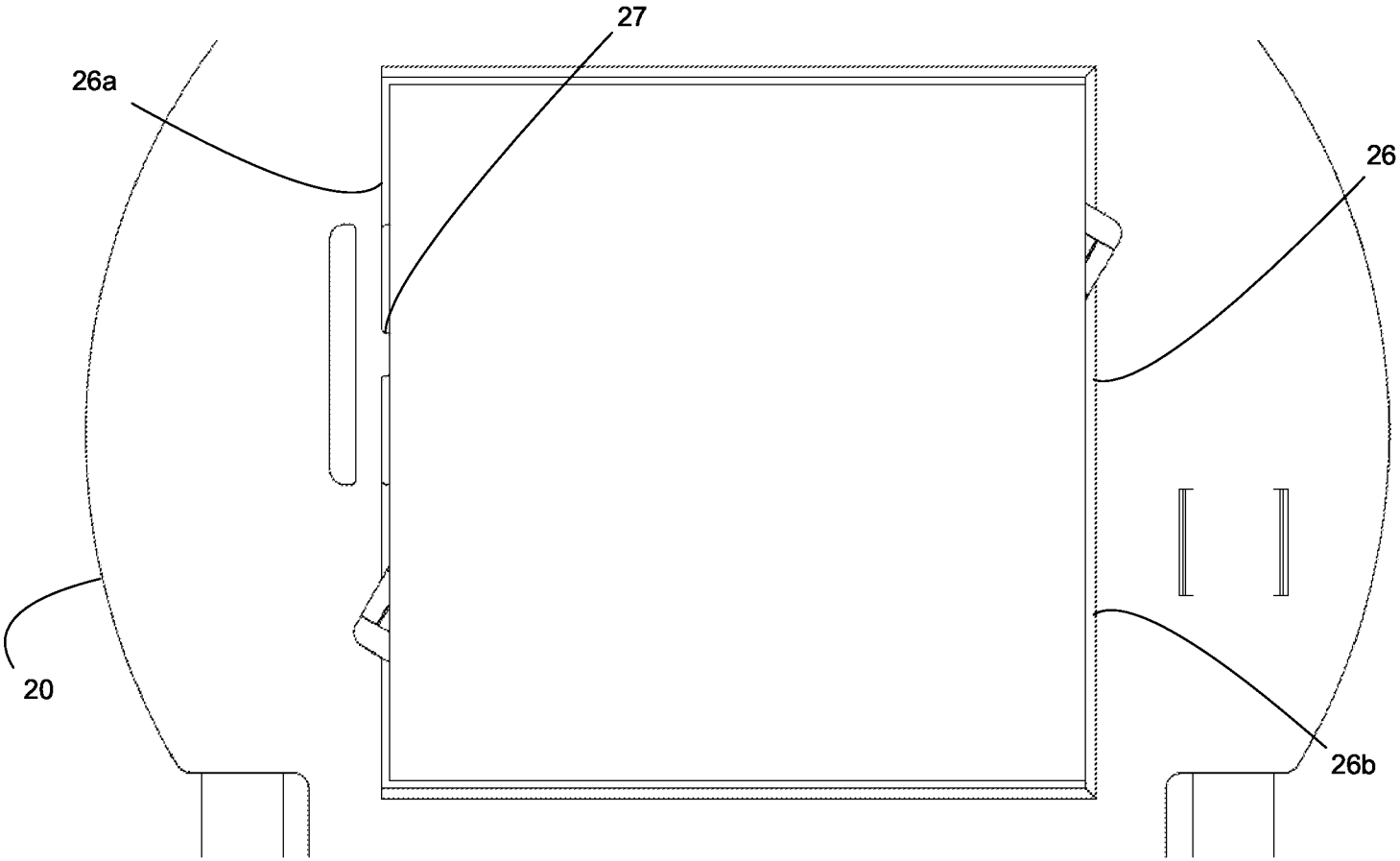
FIG. 2B illustrates an enlarged bottom view of the embodiment depicted in FIG. 2A.
Figure 3:
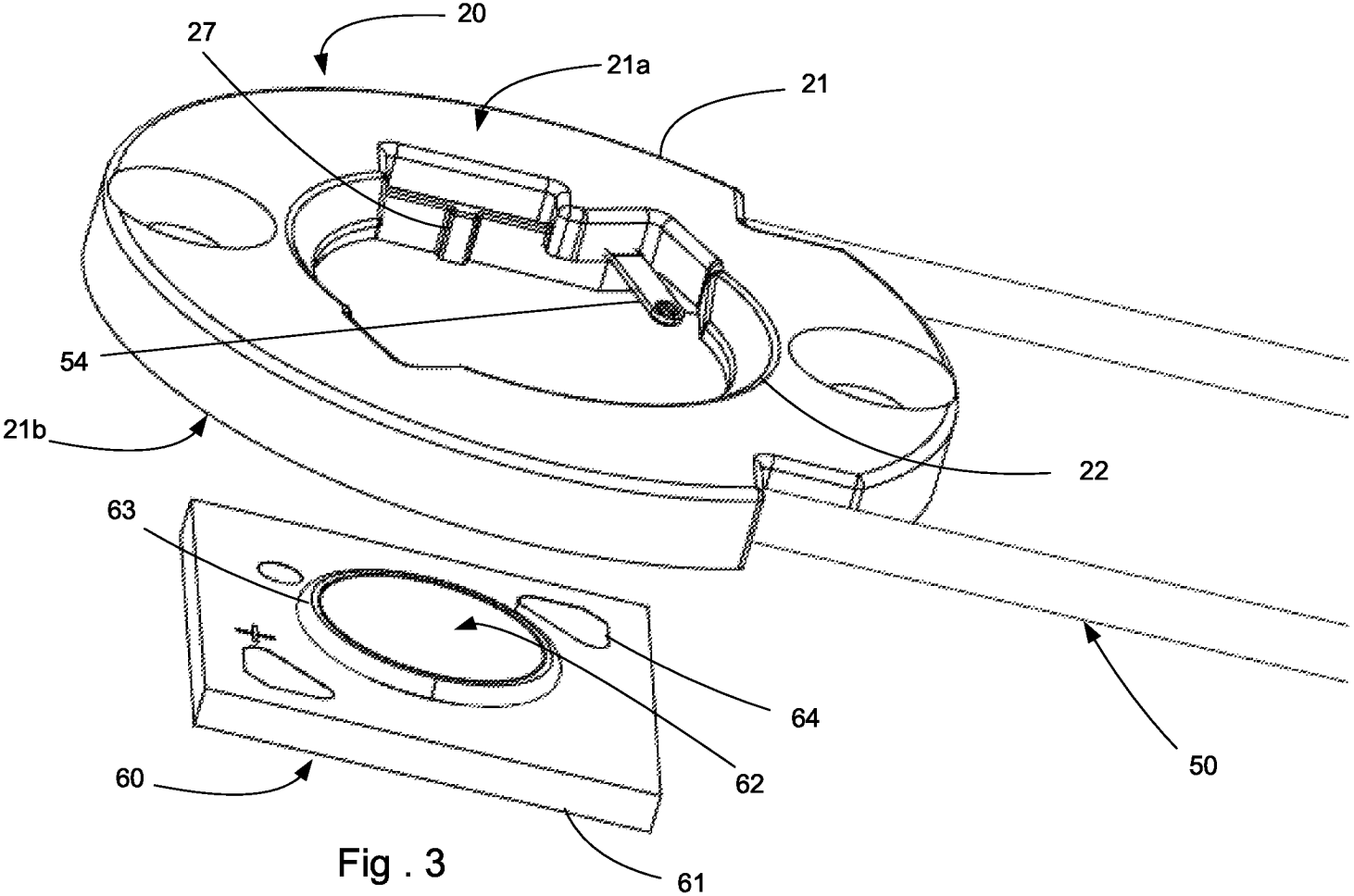
FIG. 3 illustrates a partially exploded perspective view of the embodiment depicted in FIG. 2A.
Figure 4:
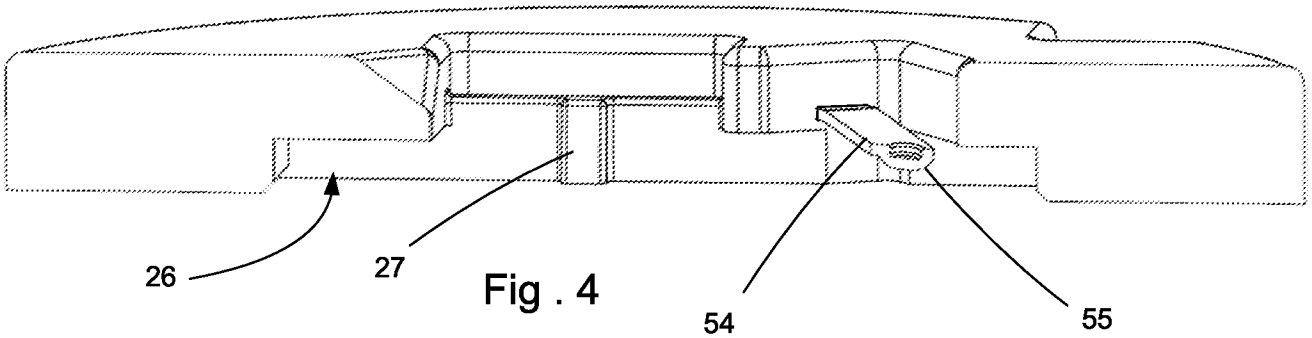
FIG. 4 illustrates a perspective view of a cross section of an embodiment of a holder.
Figure 5:
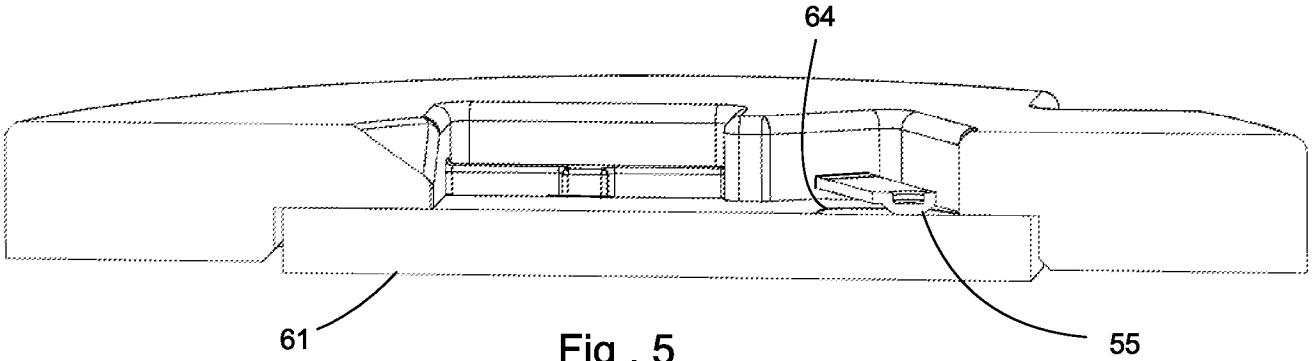
FIG. 5 illustrates a perspective view of the embodiment depicted in FIG. 4 with an LED module depicted.
Figure 6:
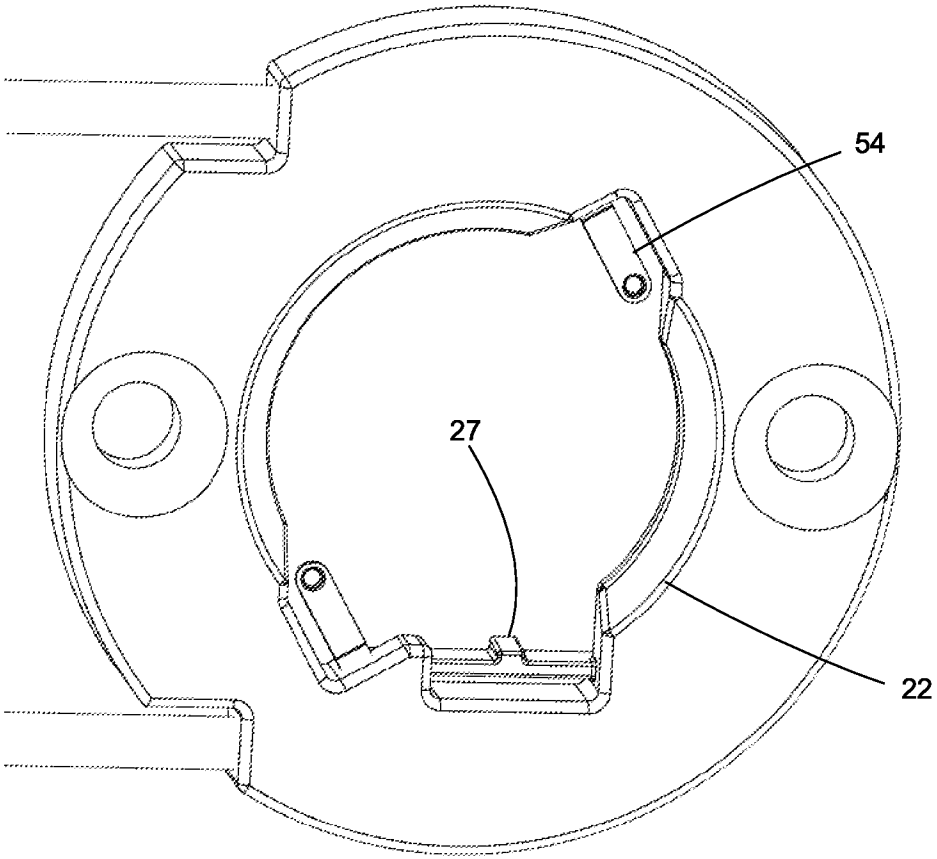
FIG. 6 illustrates a perspective view of an embodiment of a holder assembly.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Turning to the FIGS. 1-10, which depict features suitable for a first embodiment, a holder assembly 20 secures an LED module 60 to a supporting substrate 10 and the supporting substrate 10 could be a fixture, heat sink or other desirable surface that is suitable to direct thermal energy away from the LED module 60. The depicted holder assembly 20 includes a housing 21 with a top face 21*a* and a bottom face 21*b*. The holder assembly 20 includes with fastener openings 24 that allow the housing 21 to be secured in place with simple fasteners such as screws or bolts. It can be recognized, however, that other known securing techniques (such as magnets, secondary frames, etc.) would also be suitable and can be substituted as desired. The housing 21 includes an aperture 22 (which may be angled to minimize interference with emitted light) to allow light emitted from an LED module 60 to travel through the housing 21 and also includes a recess 26 on a bottom face 21*b* that is configured to receive the LED module 60 and is aligned with the aperture 22.

As is common, the LED module 60 can include a base 61 that includes pads 64 and supports an LED array 63 of one or more LED chips positioned beneath a phosphor layer 62. It has been determined that the recess 26 can be configured to have an interference fit with the base 61. As depicted, for example, a projection 27 in the recess 26 can have an interference fit with the base 61 rather than use a solder or adhesive to secure the LED module 60 to the holder 20. The base 61 is often made of a thermally conductive, relatively non-deforming material such as aluminum alloy. When the base 61 is positioned in the recess 26, the base 61 presses against the projection 27. The projection 27, being formed of a material that has a substantially lower modulus of elasticity than the base 61, (typically an order of magnitude lower although such a difference is not required) will deflect and allow the base 61 to be held in position in the holder 20 via friction, thus helping to ensure the LED module 60 is retained in the holder 20. In an embodiment the distance the projection 27 is deflected can be in the range of 0.15-0.35 mm.

As depicted, the recess has a first edge 26*a* that is next to the projection 27 and a second edge 26*b* that is opposite the first edge 26*a*. As can be appreciated, when pressing together to components that are designed to have an interference fit, it is beneficial to provide some amount of lead in to help ease the process of assembly. Due to the fact that base 61 can be relatively thin, the use of a lead-in or chamfer removes some of the surface that would normally be used to hold the LED module in place. It has been determined, however, that while it removes some of the surface that would engage the base, it is desirable to have the chamfer on second edge 26*a*. Thus, as can be appreciated from FIG. 2B, the base 61 is line to line along the second edge of the recess 26 and is shown overlapping the projection 27 (thus ensuring there is an interference fit between the housing 21 and the LED module 60) and the chamfer is provided along the second edge 26*b*.

It should be noted that while the interference fit is depicted as being provided by the projection 27, in an alternative embodiment the interference fit can be obtained by having the recessed slightly undersized. One benefit of using the projection is that the deflection of the projection can be more readily managed while accounting for possible tolerance stack-up issues. In addition, the projection 27 extends down below the point of extension of the terminal 54 so that the terminal 54 cannot push the LED module out of the holder 20.

While the step of inserting the LED module 60 into the holder 20 will secure the holder 20 and LED module 60 together, it has been determined that it is desirable to securely fasten the resultant holder assembly 20 to a supporting substrate 10. Depicted fasteners 15 can be used to compress the LED module 60 between the support substrate 10 and the holder 20 and help ensure a reliable electrical connection between terminals 54 provided in the holder and the pads 64 on the LED module 60. In addition, the fastener 15 can also help ensure that there is a reliable thermal connection between the LED module and a supporting substrate (thus helping to ensure the LED has a suitably long life). To help protect for thermal issues, as is known, a thermal interface layer can be provided between the LED module 60 and the supporting substrate 10. Such a thermal interface layer can be a thermal grease or thermal tape or other suitable materials that can be provided on a lower surface of the LED base 60.

Figure 7:
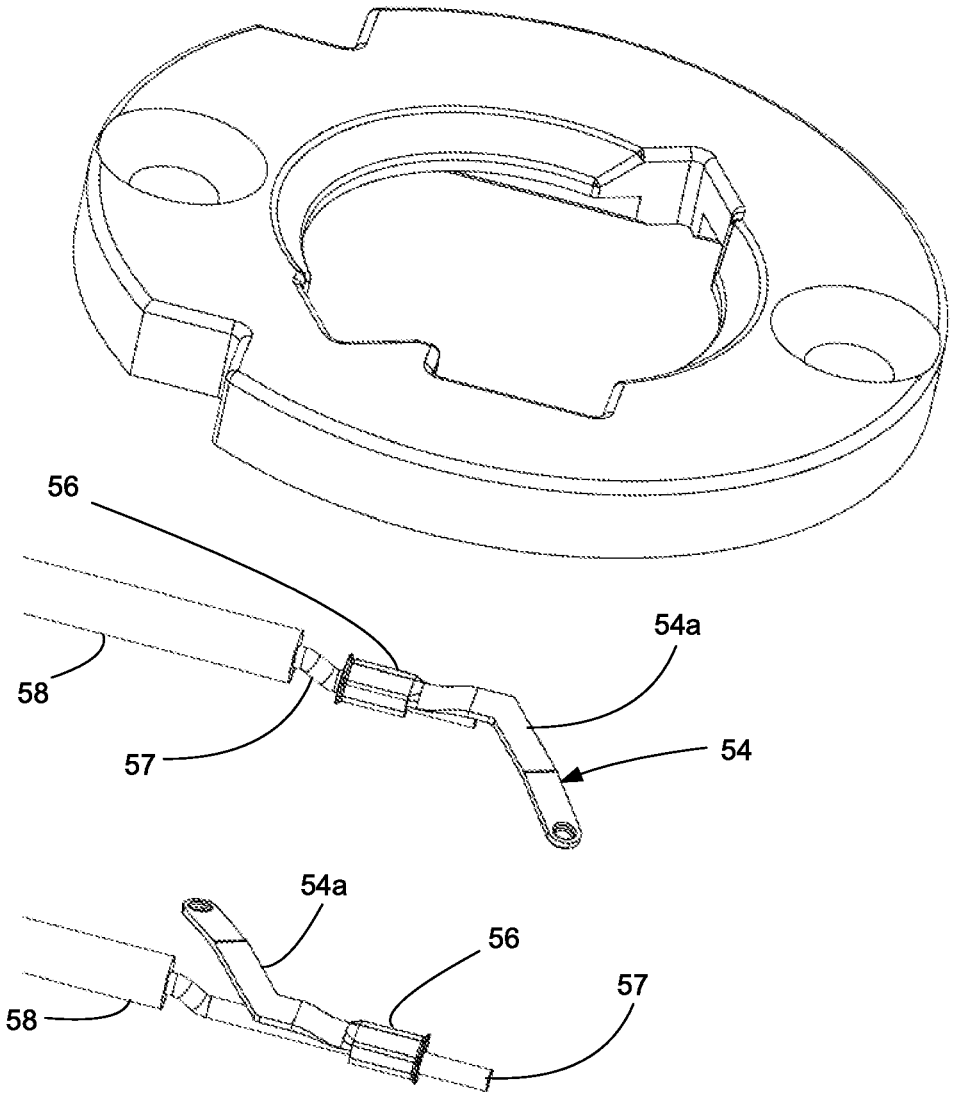
FIG. 7 illustrates an exploded perspective view of a holder assembly.
Figure 8:
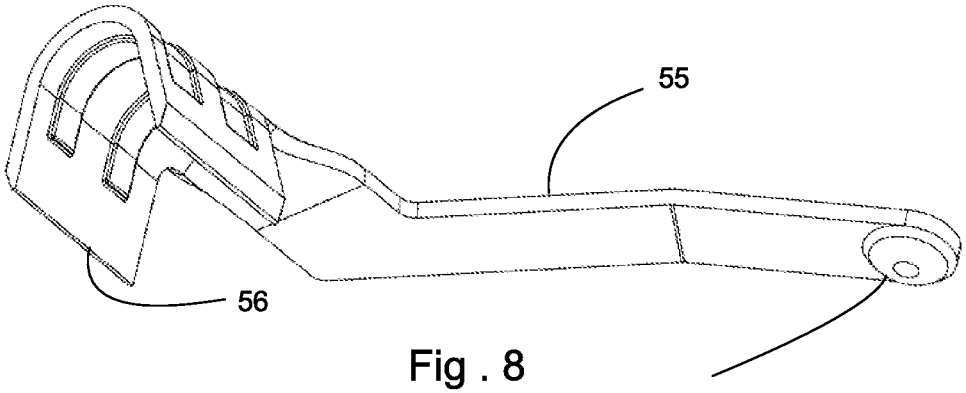
FIG. 8 illustrates a perspective view of an embodiment of a terminal.
Figure 9:
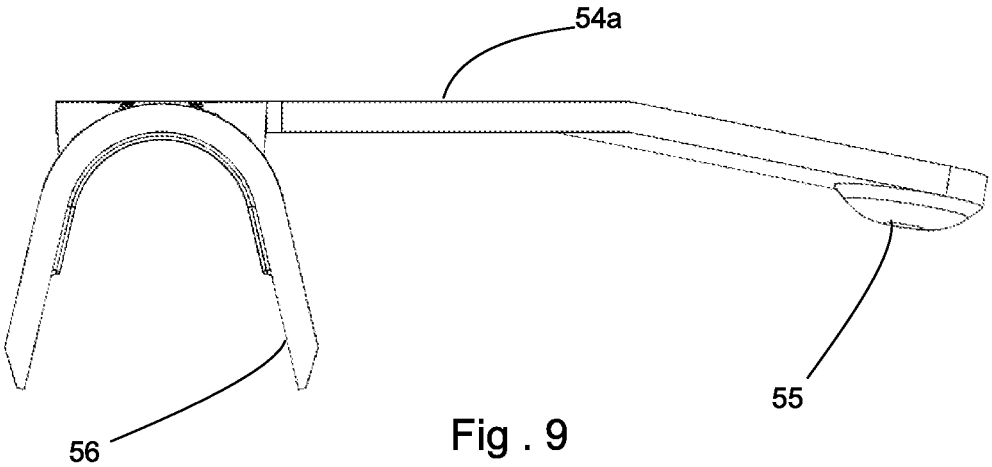
FIG. 9 illustrates an elevated rear view of the terminal depicted in FIG. 8.
Figure 10:
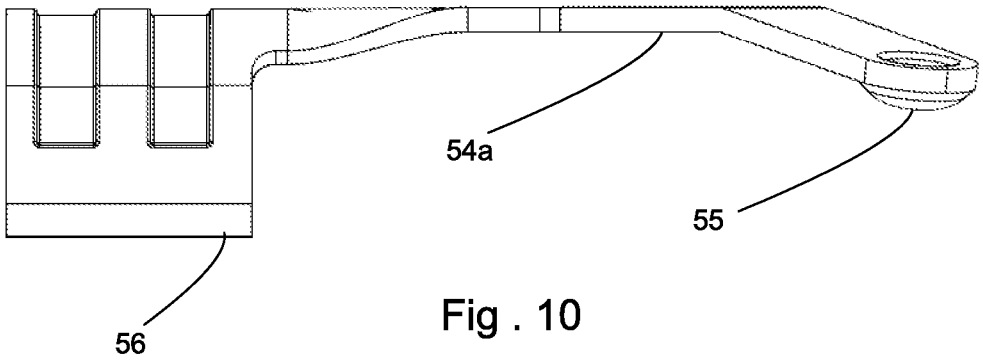
FIG. 10 illustrates an elevated side view of the terminal depicted in FIG. 8.
Figure 11:
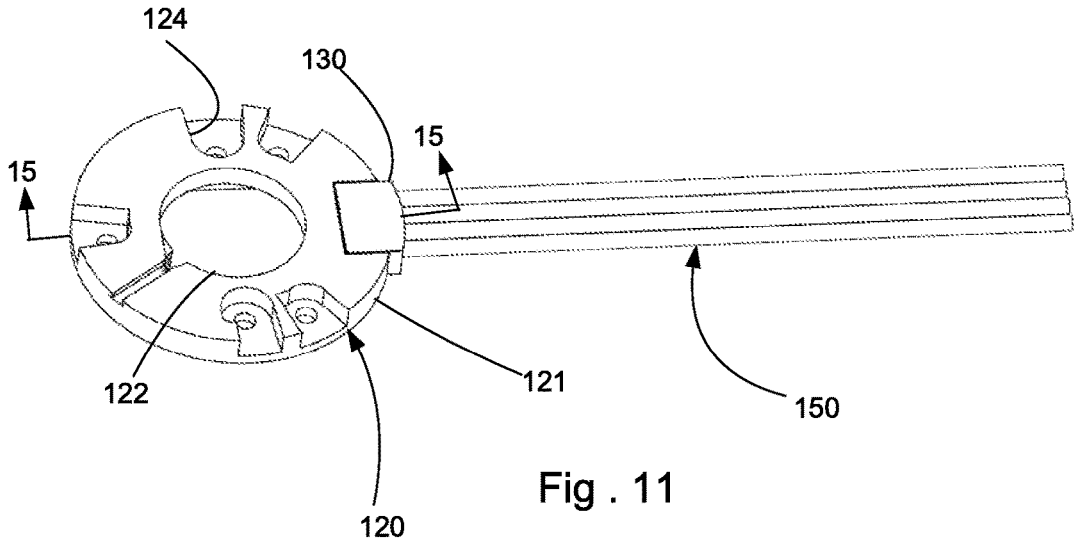
FIG. 11 illustrates a perspective view of another embodiment of a holder assembly.
Figure 12:
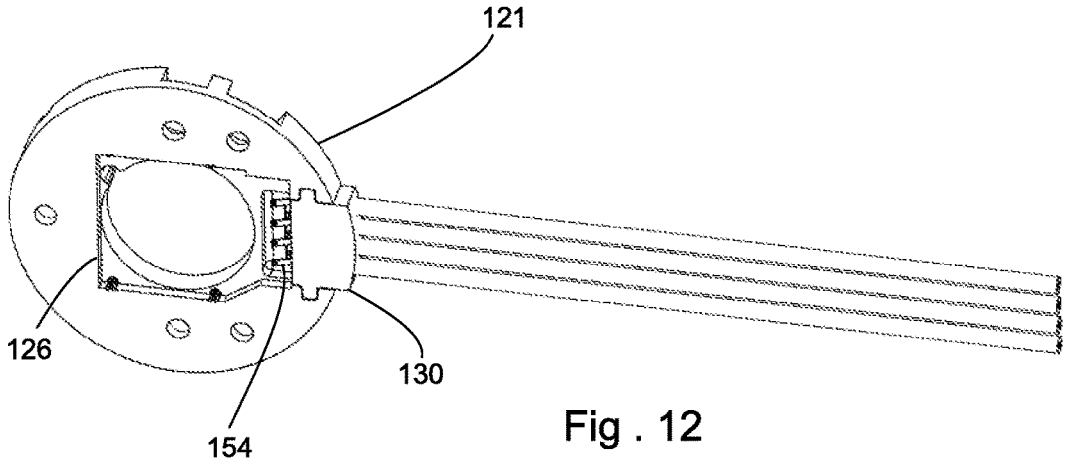
FIG. 12 illustrates another perspective view of the embodiment depicted in FIG. 11.
Figure 13:
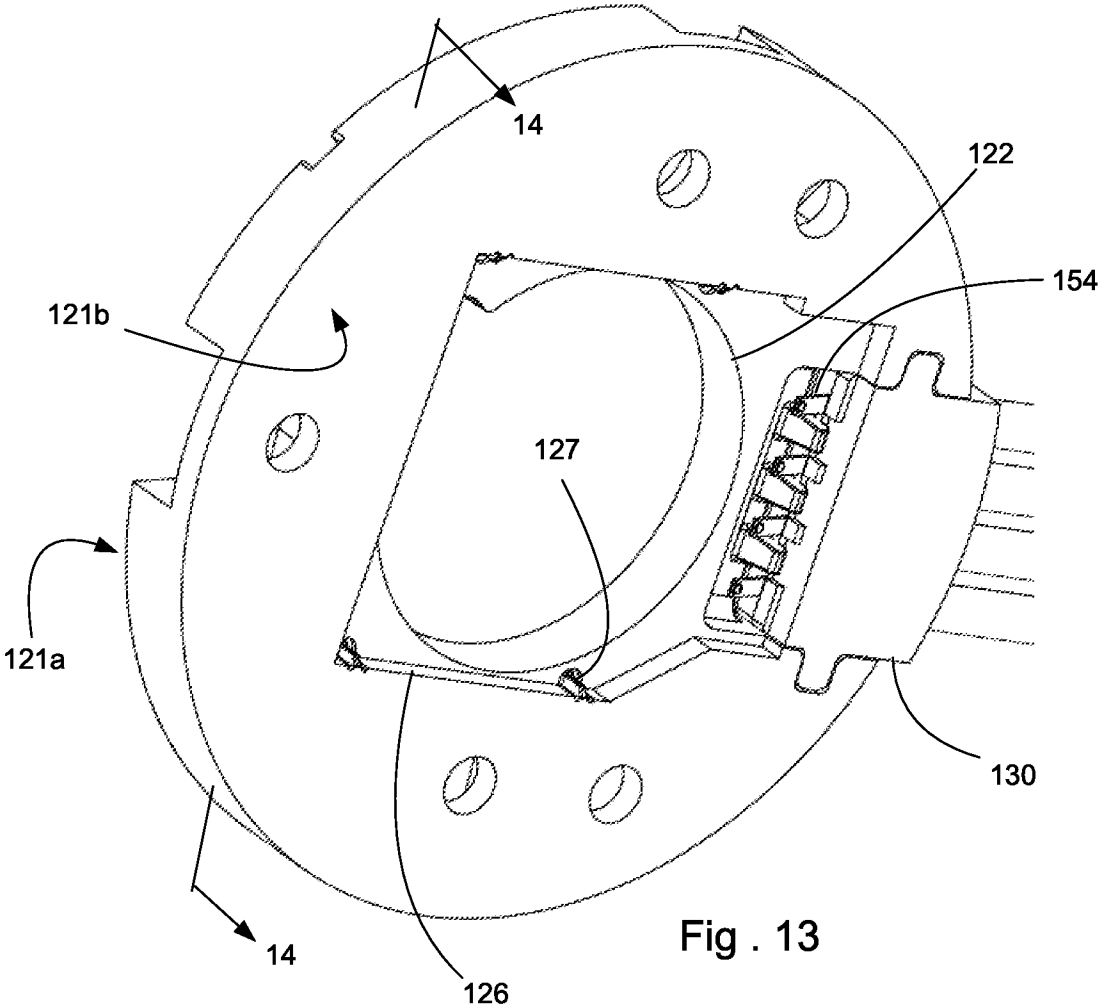
FIG. 13 illustrates an enlarged perspective view of the embodiment depicted in FIG. 12.
Figure 14:
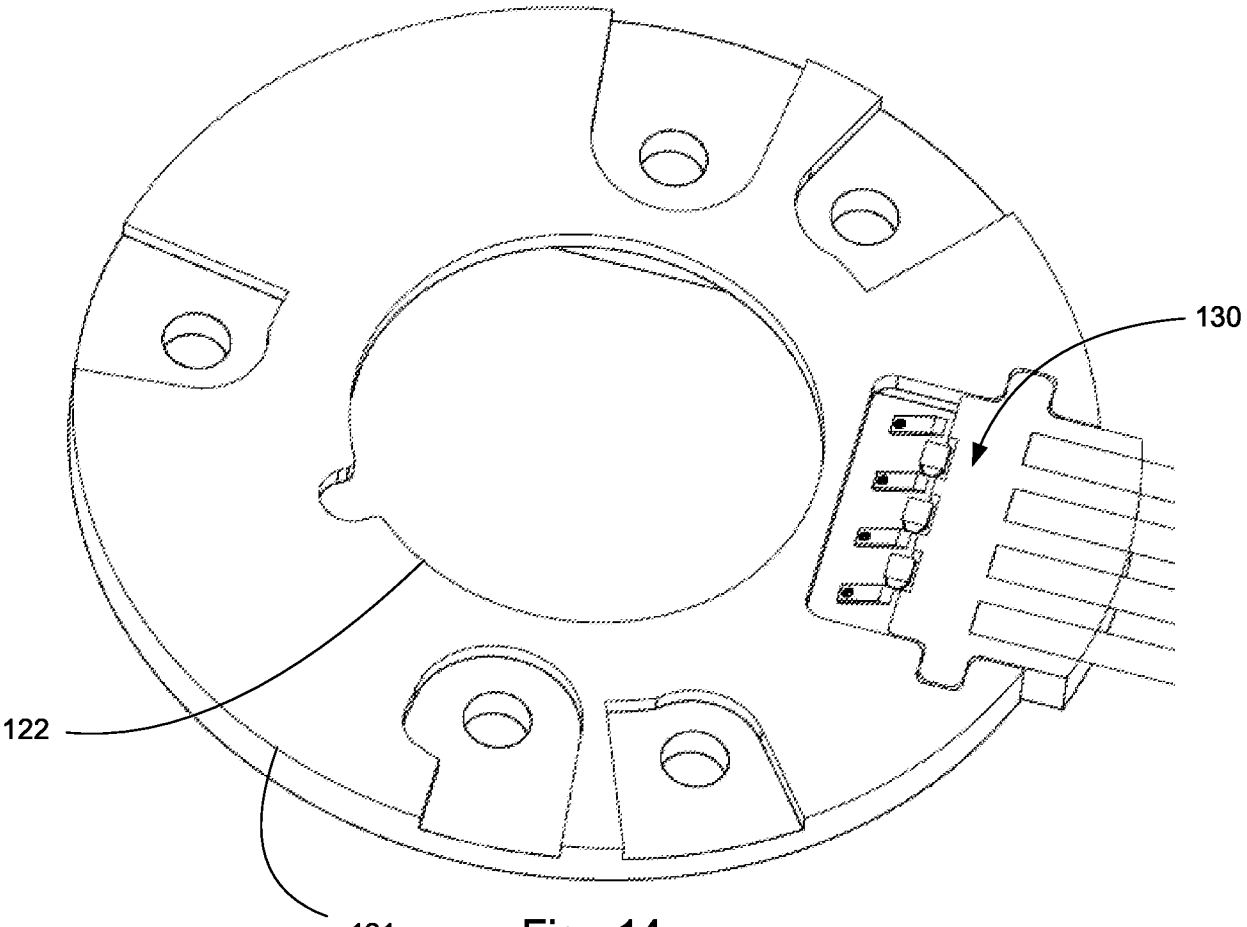
FIG. 14 illustrates a perspective of a cross section of the embodiment depicted in FIG. 13, taken along line 15-15.
Figure 15:
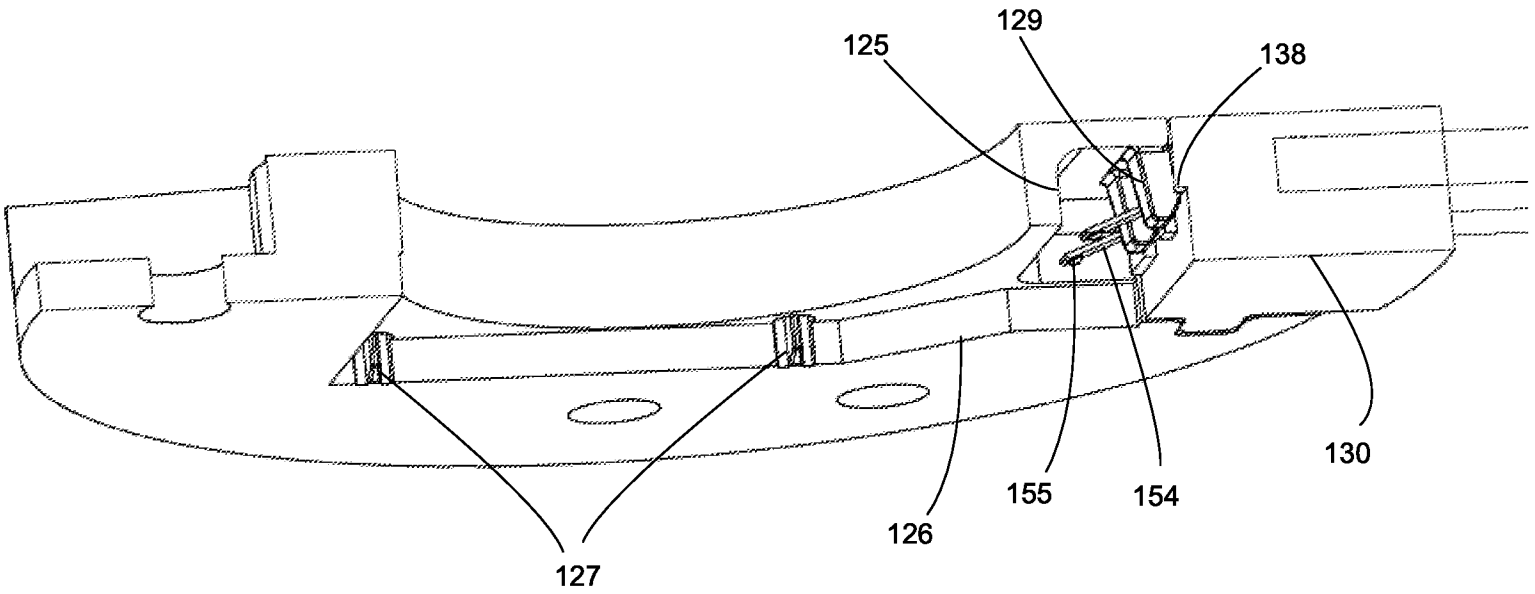
FIG. 15 illustrates a perspective of a cross section of the embodiment depicted in FIG. 11, taken along line 15-15
Figure 16:
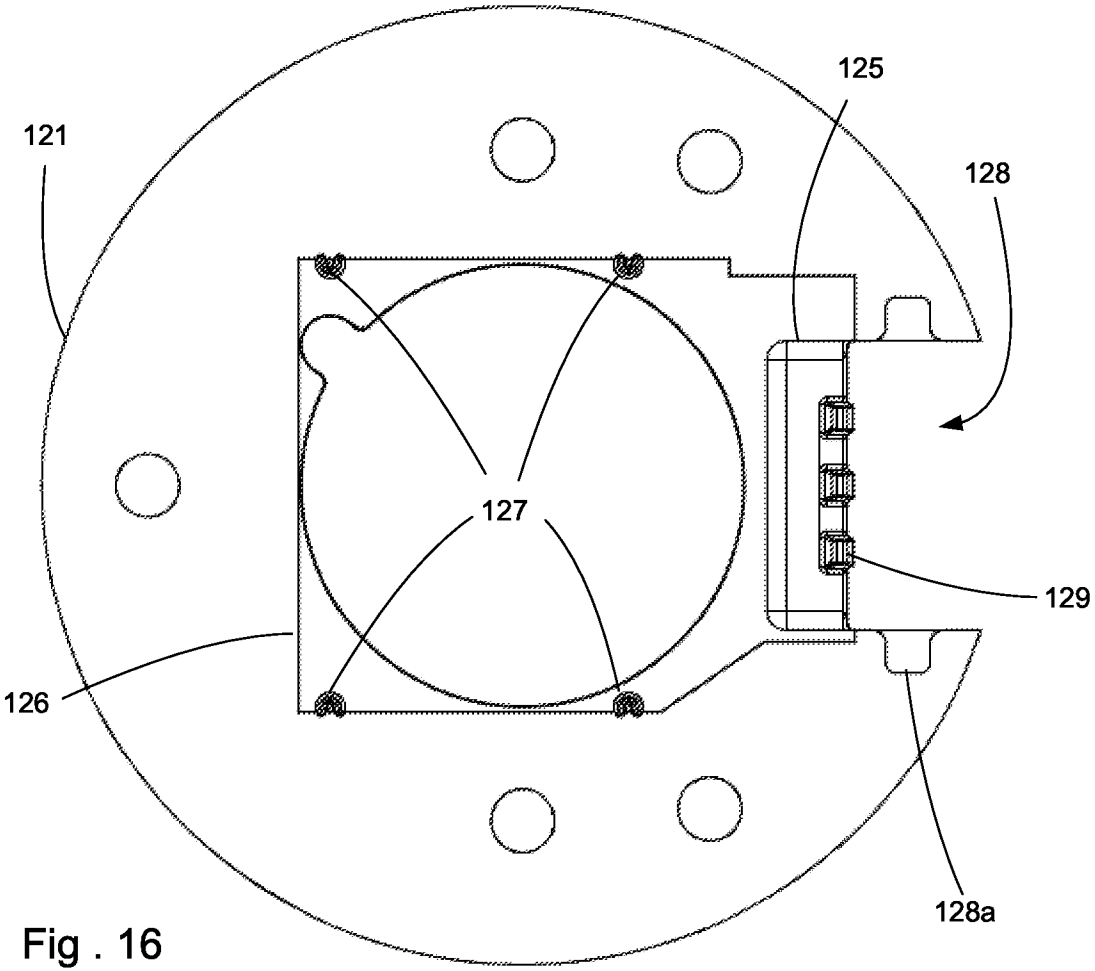
FIG. 16 illustrates a bottom view of the embodiment depicted in FIG. 13 with plug module omitted for purposes of illustration.
Figure 17:
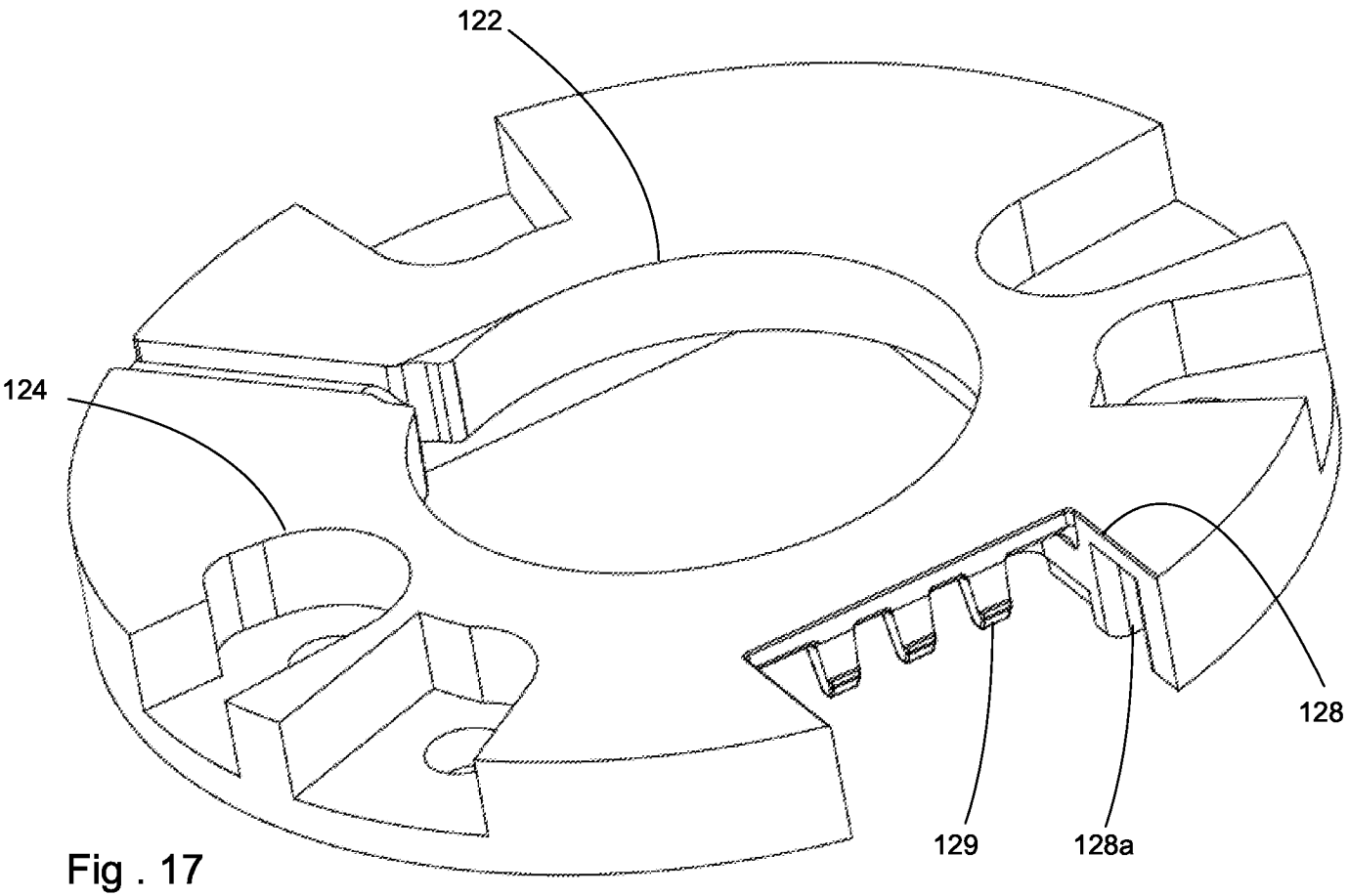
FIG. 17 illustrates another perspective view of the embodiment depicted in FIG. 16.
Figure 18:
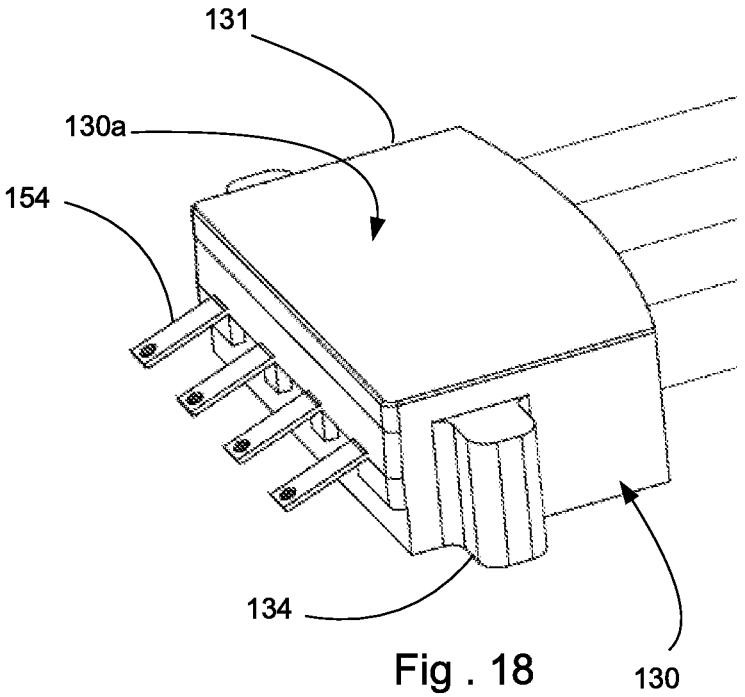
FIG. 18 illustrates a perspective view of an embodiment of a plug module.
Figure 19:
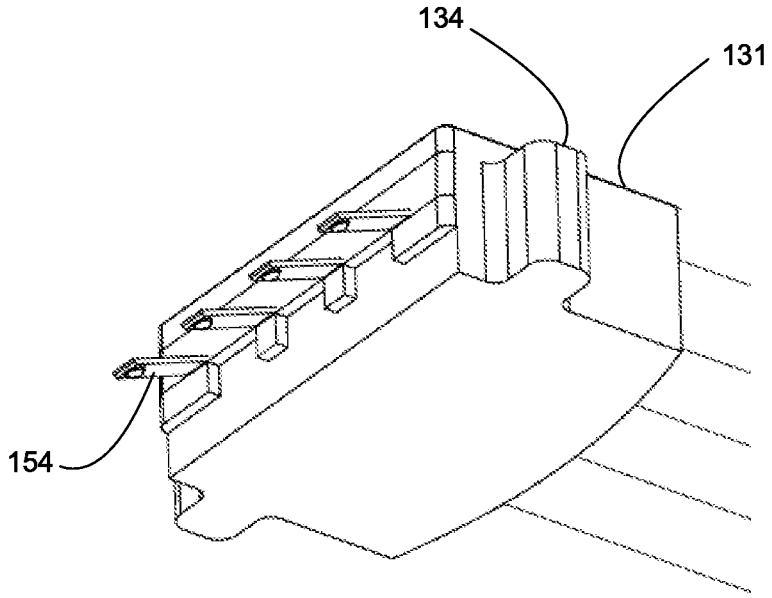
FIG. 19 illustrates another perspective view of the embodiment depicted in FIG. 18.
Figure 20:
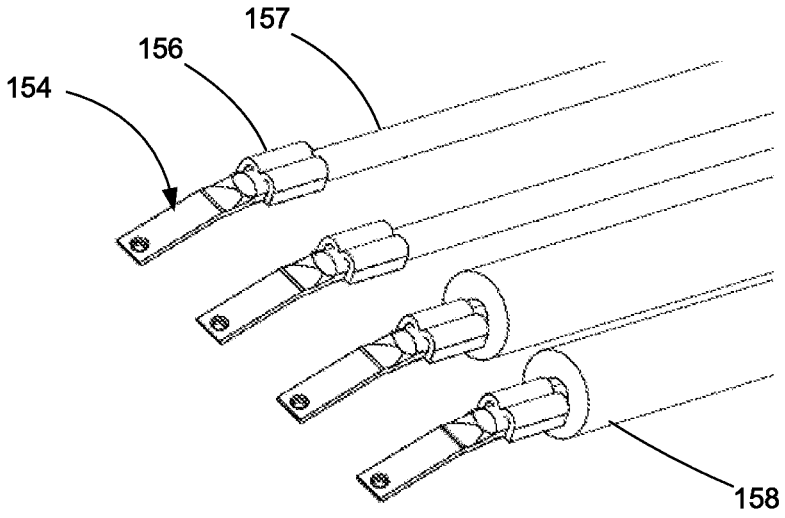
FIG. 20 illustrates a perspective simplified view of a plurality of terminals and conductors.
Figure 21:
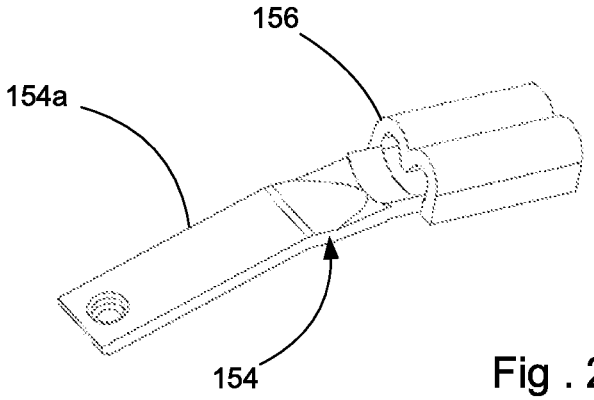
FIG. 21 illustrates a perspective view of an embodiment of a terminal.
Figure 22:
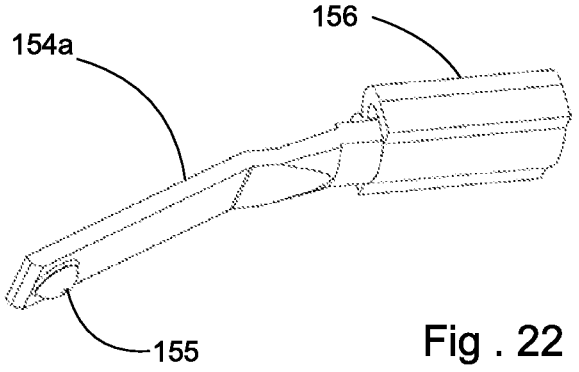
FIG. 22 illustrates another perspective view of the embodiment depicted in FIG. 21.

The holder 20 includes terminals 54 that each are insert molded into the housing 21 so that leg 54*a* extends out of the housing 21 and has a contact 55 at a distal end (the contact as can be appreciated, can be a simple dimple). The terminal 54 further includes a crimp 56 that is used to secure the terminal 54 to conductor 57 of cable 50. The conductor 57 is covered an insulation layer 58. As can be appreciated, the terminals 54 are first crimped to the conductors 57 in a desired orientation. As depicted in FIG. 7, one terminal 54 is rotated 180 degrees compared to the other terminal 54 but such a construction is optional and would depend on the configuration of the LED module and whether different terminals were used for both sides or if the same terminals were used for both sides. When the terminals 54 are insert molded into the housing 21, the leg 54*a* extends out of the housing into the recess 26 so that the contact is supported and can engage the corresponding pad 65. The resultant structure acts of the housing 21 acts to provide strain relief for the terminals and thus helps to provide a robust holder assembly 20.

One benefit of the depicted design is that the cables 50 can have color-coded insulators. As can be appreciated, this can be helpful in situation where the holder assembly 20 is going to be manually connected to a power source. For example, the insulators can be color coded so that it is clear which conductor is connected to the anode and which conductor is connected to the cathode. In an embodiment the conductors 57 can be terminate with a connector (not shown) at a distal end. Naturally, if the conductors are terminated to a connector then the conductors can be reliably connected into a system (assuming the connector is suitably configured). However, even without an optional connector, (which can potentially increase costs while also improving reliability) the color coding can substantially improve the ability of a user to appreciate which insulated conductor is the anode.

As can be appreciated, the housing 21 can be relatively thin. In an embodiment, for example, the thickness of the housing can be a cable diameter plus 0.7 mm of housing on both sides of the cable. While the housing 21 could be formed in a thinner manner, the use of the 0.7 mm thick housing (on each side of the cable 50) has been determined to be reliable as it aids in obtaining UL approval. Otherwise it is expected that a minimum thickness of the base could be about 0.4 mm on both sides of the cable and still be moldable using reasonable molding techniques. It is expected that the maximum desired thickness of the base on each side of the cable would have be a thickness of about 1.5 mm, thus providing a total thickness of about 3 mm plus the cable diameter.

It should be noted that the depicted embodiment crimps the terminal 54 to the conductor 57. This is reliable but the connection between the terminal 54 and the conductor 57 could also be provided with a solder connection. It should also be noted that the cable could extend out the bottom of the LED holder assembly if desired.

Regardless of the configuration, the existing design can be made relative small while provide good creepage and clearance. In an embodiment it is possible to provide 2000 volts of isolation in a 25 mm diameter, low profile package. It should also be noted that while cables are depicted, flexible printed circuits (FPC) could also be used if desired.

As depicted, fasteners are intended to press down on the holder 20 onto the supporting surface 10, which in turn presses down on the base 61 of the LED module 60 toward the supporting surface 10. To ensure reliable thermal connections, the housing 21 can therefore transfer force from the fasteners 15 to the base 61. The terminals 54 can separately press down on the pads 64 due to the fact that they are configured to deflect when the LED module is inserted into the holder. Thus, the terminals 54 are configured to provide a force that makes an electrical connection with the pads 64 of the LED module 60 and that force is not directly dependent on the force applied by the fastener. Or, to put it another way, once the LED module 60 is inserted into the holder assembly 20, the design of the terminal 54 and the deflection that occurs will determine the force applied by the terminals 54 on the pad of the LED. This force, however, will not substantially increase in spite of an increase in the force that the fasteners 15 exert on the holder 20. Thus, the depicted design is able to avoid damage that might occur to the terminals 54 if the fasteners 15 were over-tightened (which, for example, could otherwise cause the terminals 54 to take a set) while allowing higher forces to be applied in order to obtain improved thermal transfer between the base of the LED module and the supporting surface.

One benefit of the depicted design is that the insert-molded housing supporting the terminals can more carefully control the location of the terminals 54 compared to other methods of supporting terminals on the housing. This allows the terminal deflection to be reduced. In an embodiment the deflection can be less than 0.5 mm when the LED module is fully inserted into the recess and in an embodiment the terminals can be configured to deflect about 0.3 mm. This is helpful because in prior art holder designs the terminals exert a force on the LED module that tends to push the LED module out of the recess. Reducing the deflection distance allows the force to be reduced, thus making it easier to have the friction caused by the interference fit between the base 61 and the projection 27 be sufficient to retain the LED module 60 in the recess 26.

FIGS. 11-22 illustrate a second embodiment of a holder assembly. A holder 120 is depicted with a housing 121. Rather than have terminals 154 insert-molded into a housing 121, the terminals 154 are insert molded into plug 130, which is mated with the housing 121. As can be appreciated, this allows for flexibility in the number of terminals and could be used to provide a holder assembly that is more flexible in the type of LED modules it can support as variations could be accounted for by a change in the plug. It should be noted that while multiple cables 150 are depicted, in an embodiment two cables 150 could be provided and other cables could be omitted. Thus the depicted embodiment provides significant flexibility.

The holder 120 includes fastener notches 124, an aperture 122 to let light pass through the holder 120 and a recess 126 aligned with the aperture and designed to fit around a base of an LED array, similar to what was depicted in FIGS. 1-10. The housing includes a top face 121*a* and a bottom face 121*b*, along with an aperture 122 intended to allow light to be emitted through the holder 120.

The plug 130 has a body 131 with a top surface 130*a* and with ears 134 on opposing sides. The top surface 130*a* can be flush with the top face 121*a* of the housing 121. The ears 134 are positioned in grooves 128*a* so that the plug 130 is properly positioned in side opening 128. Terminals 154 are insert-molded into the body 131 and include a leg 154*a* that extends out of the body 131 so that contacts 155 are positioned in channel 125. Fingers 129 can be provided in the channel 125 and can be configured to be positioned between adjacent terminals 154. The fingers 129 can engage lip 138 and thus can help secure the plug 130 into position in the opening 128.

To secure a LED module in the recess 126, multiple projections 127 are provided. As discussed above, the projections 127 and the terminals 154 can be configured so that the terminals 154 do not continue to push a corresponding LED module out of the recess 126 because the deflection of the terminals 154 is too small. As in the prior embodiment, terminals 154 can have a crimp 156 that crimps conductor 157 and an insulative cover 158 can cover the conductor 157. Alternatively, any other desirable means (such as soldering, welding, adhesive, etc.) can be used to electrically connect terminal 154 to conductor 157.

In operation, the holder 120 can provide functionality similar to the functionality of the embodiment depicted in FIGS. 1-10. Specifically, the holder 120 can ensure that once a LED module is inserted into the holder assembly 120, the design of the terminals 154 and the deflection that occurs will determine the force applied by the terminals 54 on the pad of the LED and this force will not substantially increase in spite of an increase in the force that the fasteners might exert on the body 121 of the holder 120. Thus, the depicted design is able to avoid damage that might occur to the terminals 154 if fasteners securing the holder 120 were over-tightened while allowing for higher forces to bias the base toward a supporting surface (which helps provide improved thermal efficiency).

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A holder assembly, comprising:

a housing with an aperture and a recess aligned with the aperture;

a first terminal insert molded in the housing, the first terminal having a first contact extending into the recess;

a second terminal insert molded in the housing, the second terminal having a second contact extending into the recess;

a first conductor with an insulative cover extending from the housing, the first terminal electrically connected to the first conductor;

a second conductor with an insulative cover extending from the housing, the second terminal electrically connected to the second conductor; and a LED module inserted into the recess, the LED module including pads configured to engage contacts provided on the terminals, wherein the terminals are configured to deflect less than 0.5 mm when the LED module is fully inserted into the recess.

2. The holder assembly of claim 1, wherein the housing includes a projection that extends into the recess.

3. The holder assembly of claim 2, wherein the first terminal and second terminal are identical and the first terminal is in a first orientation and the second terminal is in a second orientation, the first orientation being 180 degrees from the second orientation.

4. The holder assembly of claim 1, wherein the LED module includes a base configured to have an interference fit with the housing.

5. The holder assembly of claim 4, wherein the housing includes a projection positioned in the recess, the base and recess configured so as to cause the projection to deflect when the base is inserted into the recess.

* * * * *